United States Patent [19]

Walles

[11] 3,996,725

[45] Dec. 14, 1976

[54] APPARATUS FOR FILLING AND HERMETICALLY SEALING THERMOPLASTIC CONTAINERS UNDER VACUUM

[75] Inventor: Wilhelm E. Walles, Midland, Mich.

[73] Assignee: The Dow Chemical Company, Midland, Mich.

[22] Filed: May 21, 1973

[21] Appl. No.: 362,560

[52] U.S. Cl. ..... 53/94; 53/101; 53/112 R

[51] Int. Cl.[2] ..... B65B 31/02

[58] Field of Search ..... 53/79, 86, 90, 91, 92, 53/93, 94, 101, 112 R

[56] References Cited

UNITED STATES PATENTS

| | | | |
|---|---|---|---|
| 2,517,569 | 8/1950 | Huzenlaub | 53/112 R X |
| 3,385,741 | 5/1968 | Allen | 29/470.3 X |

*Primary Examiner*—1
*Assistant Examiner*—Travis S. McGehee
*Attorney, Agent, or Firm*—M. S. Jenkins

[57] ABSTRACT

Thermoplastic containers are filled with materials such as particulate solids or liquids under vacuum and hermetically sealed in rapid succession by an apparatus having a means for evacuating the container, means for filling and hermetically sealing the evacuated containers while retaining the vacuum.

1 Claim, 2 Drawing Figures

APPARATUS FOR FILLING AND HERMETICALLY SEALING THERMOPLASTIC CONTAINERS UNDER VACUUM

BACKGROUND OF THE INVENTION

This invention relates to an apparatus for filling plastic containers under vacuum and hermetically sealing the containers.

Recently, there have been devised thermoplastic polymers and laminate structures including such polymers which are substantially impermeable to the gases of the atmosphere. Accordingly, it is now possible to make containers of such materials which, after evacuation, can retain a vacuum for a substantial period of time. In many applications, it is desirable to package or otherwise enclose certain materials in such vacuumized plastic containers so that the packaged or enclosed material remains under vacuum. Heretofore, apparatus and methods for rapidly packaging or enclosing materials in vacuumized plastic containers have not been disclosed.

SUMMARY OF THE INVENTION

In accordance with the present invention, rapid, repetitive packaging or enclosing of materials under vacuum is accomplished using the apparatus as described hereinafter. The apparatus comprises (1) a housing defining an inlet for receiving a thermoplastic container having an open end through which the container can be filled with material, a chamber for enclosing the container under vacuum while the container is being filled, and an outlet for discharging the container after it is filled and sealed; (2) a plurality of port valves disposed within said chamber, said valves, when closed, subdividing said chamber into at least three air locks including in sequential order an entry lock, an operation lock and an exit lock, and, said valves, when opened, permitting the passage of the container therethrough; (3) evacuating means in communication with each of the three air locks; (4) a receptacle holding the material under vacuum in communication through a conduit with said operation lock; and (5) a remote control means for hermetically sealing said containers disposed in the operation lock of said chamber.

Throughout operation of the apparatus the operation lock and the receptacle are maintained under vacuum. In operation the container with the open end outward is inserted into the entry lock. A first and second port valve defining the entry lock are closed, and the entry lock is evacuated. The second port valve separating the entry lock from the operation lock is opened allowing the container to gravitate to a position in the operation lock such that the open end of the container is in communication through the conduit with the receptacle. A desired amount of the material is conveyed under vacuum from the receptacle into the open end of the container, and the open end of the container is hermetically sealed by activating the remote control sealing means. A third port valve separating the operating lock and the exit lock previously evacuated is opened allowing the container to gravitate into the exit lock. The third port valve is closed and a fourth port valve separating the exit lock from the outside is opened allowing the container to pass out of the apparatus.

The apparatus of the present invention is useful in the filling under vacuum of such containers as plastic vacuum bottles, food containers and the like.

BRIEF DESCRIPTION OF THE DRAWINGS

In the drawings, a single form of the invention is shown, but it is to be understood that the invention is not limited to such form since the invention as set forth in the claims may be embodied in a plurality of forms.

DESCRIPTION OF THE PREFERRED EMBODIMENTS

Figures 1, 1A:
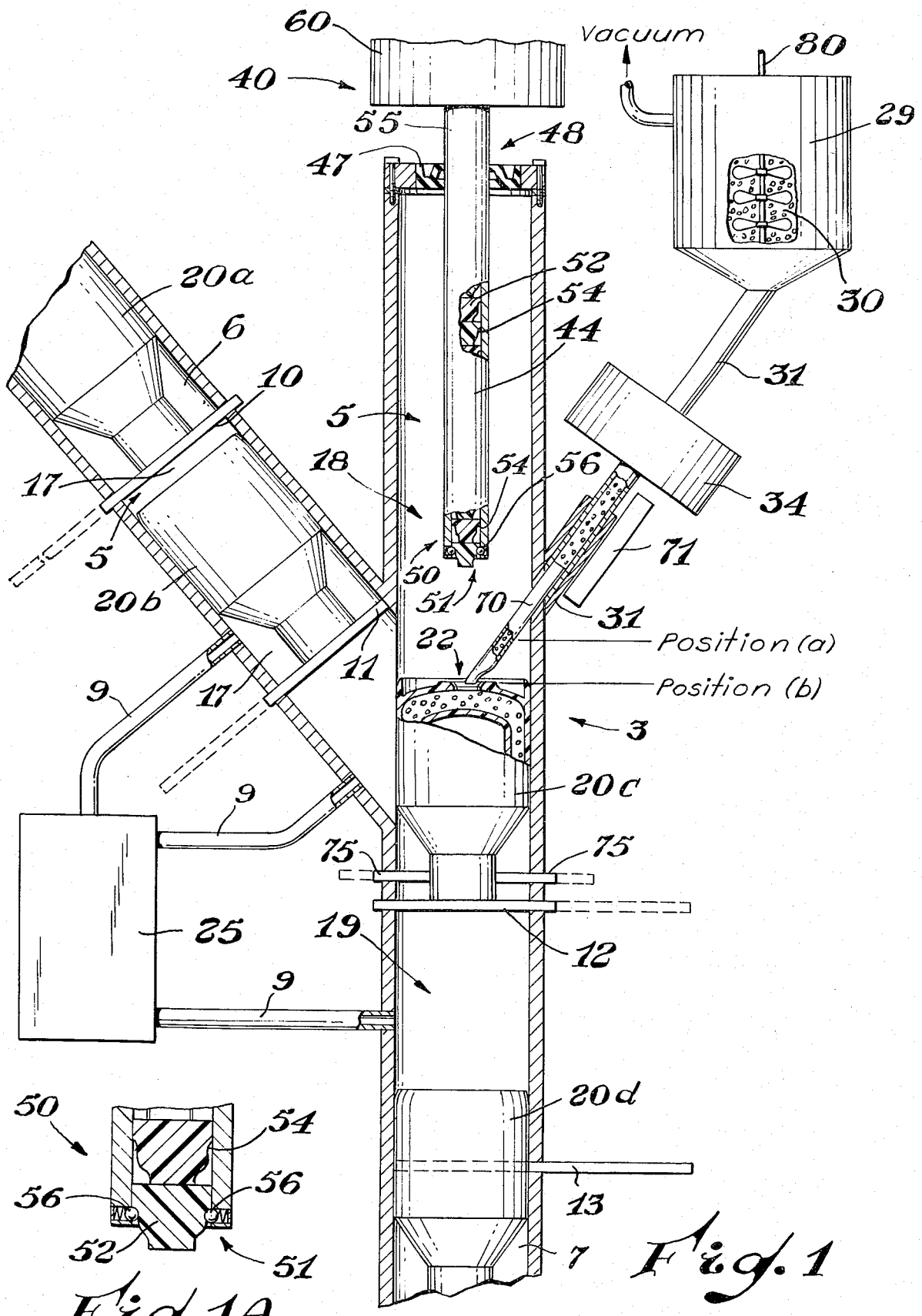
FIG. 1 is a vertical, sectional view of one embodiment of the apparatus as employed in vacuumizing and filling a plastic vacuum bottle.
FIG. 1*a* is a sectional view of the socket end of the sealing means.

With reference to FIG. 1, the invention is shown as an apparatus for filling under vacuum the enclosed space of the plastic bottle having double wall construction with a gas absorbing particulate solid. Accordingly, the apparatus of FIG. 1 has a housing 3 defining a generally upright chamber 5, an inlet 6 for receiving the plastic bottle 20*a* with the open end 22 being directed outward from the center of the apparatus, and an outlet 7 for discharging the bottle 20*d*. Four gate valves 10, 11, 12 and 13 are disposed in the chamber 5 such that when the gate valves are closed, chamber 5 is divided into an entry air lock 17, an operation air lock 18, and an exit air lock 19. When the gate valves are open, the bottle can pass through the valve from one air lock to the next and then out of the apparatus. An evacuating means 25 is separately in communication through conduits 9 with each of the three air locks. A receptacle 29 holding material 30 under vacuum comunicates through a conduit 31 with the operation lock 18. Beneficially, an externally driven stirring means 80 is disposed in receptacle 29 to facilitate downward movement of material 30. Advantageously placed in the conduit 31 is a metering means 34 for supplying a measured amount or shot of the material into the open end 22 of bottle 20*c* residing in the operation lock 18. The particulate solid or other material is conveyed into the open end of the bottle by a funnel member 70 slidably mounted in the conduit 31 for reciprocation from a position (a) to a position (b) directly above the open end of the bottle. After gate valve 11 is opened allowing the bottle to gravitate into the operation lock 18, funnel member 70 is moved from position (a) to position (b) by magnetic means 71 located outside conduit 31. In such a case the metal used in construction of conduit 31 and body 3 is a non-magnetic metal such as brass and the funnel member 71 is constructed of magnetic metal such as iron or magnetic steel. The material is then released from the metering means 34 and is conveyed by the conduit 31 and funnel member 70 into the open end 22 of the bottle 20*c*. After filling is completed, the funnel member 70 is returned to position (a) and the sealing operation is begun as described hereinafter.

Residing in the lower end of operation lock 18 are two or more guide clamps 75 slidably mounted in the wall of the operation lock 18. As bottle 20c contacts closed gate valve 12, the guide clamps 75 are moved to contact the neck of bottle 20*c* thereby positioning the bottle 20*c* in operation lock 18 for receipt of material 30 through opening 22. The clamps 75 remain in said contacting position until bottle 20*c* is sealed.

A remote controlled sealing means 40 is slidably disposed in the uppermost end of housing 3. The sealing means 40 comprises a reciprocal, rotatable hollow shaft 44 slidably disposed lengthwise in the operation lock 18, and means 60 for inserting thermoplastic plugs into the hollow of the shaft 44. The sealing means 40 is driven by a rotating and reciprocating drive means. A vacuum seal 47 is mounted in port 48 such that the seal bears circumferentially on the shaft 44. Centered in end 50 of the shaft is a hexagonal socket 51 for holding a hexagonal thermoplastic plug 52 to be used for sealing the bottle after vacuumization and filling. Means 60 supplies under vacuum thermoplastic plugs 52 to the hexagonal socket 51 of the shaft 44 at timed intervals through the hollow of shaft 44. Preferably, the exterior surface of the shaft is cylindrical and the hollow of the shaft 44 is hexagonal in order to convey the hexagonal plug to the socket 51 in the correct position. Obviously, the plug can be square, circular if grooved or notched, etc. in which case the hollow of shaft 44 is shaped to accommodate the plug and convey it into the socket 51 in the correct position.

Preferably, as depicted in FIG. 1, several plugs 52 are stacked in the shaft 44 in the correct position and can be moved into the socket 51 by activating means 60. As an example, a rod slidably disposed in the means 60 and extending lengthwise into the hollow of shaft 44 is urged against the uppermost plug in the hollow of shaft 44 thereby forcing the stack of plugs downward until the lowermost plug in the hollow of shaft 44 is inserted into socket 51. As each additional plug is inserted into socket 51, the plug residing in socket 51 is forced out of the socket 51. As more clearly depicted in FIG. 1*a*, a spring loaded ball clamp 56 is mounted in socket 51 to hold each plug as it is urged into the socket 51. Beneficially, each plug has a notch 54 for receiving ball or balls of clamp 56 as the plug is moved into socket 51. As the plug in the socket 51 is forced out, the ball or balls of clamp 56 recedes into the wall of shaft 44 until the plug slips out of the socket 51 at which time the spring of the clamp forces the ball or balls back into position to catch the next plug entering into socket 51. Advantageously, as the stack of plugs in the shaft is depleted, a new stack is inserted by conventional means. For example, another stack of plugs sealed in an evacuated cartridge can be affixed to the end 55 of shaft 44 and injected under vacuum into the hollow of shaft 44.

During operation, the operation lock 18, the conduit 31, and the receptacle 29 are maintained under vacuum. In operation, the bottle 20*b* is placed into the entry lock 17 of the chamber. Gate valve 10 is closed and the entry lock 17 is evacuated. Gate valve 11 is opened allowing the bottle to gravitate into the operation lock 18 and gate valve 11 is closed. When the open end 22 of bottle 20*c* is in communication with the conduit 31, the metering means 34 is opened allowing a shot of material 30 to pass through the open end 22 into the bottle 20*c*. Means 60 is activated to insert and to fix thermoplastic stopper 52 into socket 51. The shaft 44 is moved downwardly to insert the thermoplastic stopper 52 into the open end 22 of the bottle 20*c* and the shaft 44 is rotated to create frictional heat in opening 22 which causes localized partial melting of the thermoplastic. Guide clamps 75 hold bottle 20*c* in a fixed position so that the rotating plug does not cause the bottle 20*c* to rotate. The rotation of shaft 44 is stopped thereby allowing the plastic to cool and solidify to form a permanent hermetic seal between plug 52 and opening 22. The exit lock 19 is evacuated and gate valve 12 is opened allowing the bottle to pass into the exit lock 19. Gate valve 12 is closed and gate valve 13 is opened allowing the bottle to pass out of the apparatus.

As an additional step in the foregoing operation, complete retention of vacuum in the operation lock is assured by continuously evacuating the operation lock during the foregoing operation.

In addition to the bottles of the type as depicted in FIG. 1, containers of a wide variety of shapes and sizes including other containers of double wall construction such as jugs, insulated liquid and food servers and the like wherein the space enclosed between the walls is filled with gas absorbing materials such as activated charcoal, metallic barium and other similar finely divided materials. Also, the apparatus of the present invention may be employed to package a wide variety of liquid and solid items such as foods and medicines in plastic containers under vacuum.

The plastic container may be fabricated of any structural plastic, e.g., polyethylene, polystyrene and others disclosed in copending application Ser. No. 305,451, or combination thereof with other metallic materials including laminate structures similar to those described in the aforementioned copending application. The stopper employed to seal the container may comprise a material similar to the aforementioned plastic or may comprise glass, metal, or other structural material or laminate thereof with plastic materials.

In addition to spin welding sealing technique described in FIG. 1, the stopper may be sealed in the open end of the container with various glues or adhesives such as resins. In such case, the shaft need not be rotatable. Also, sealing may be effected by vibrating the shaft, e.g., with ultrasonic vibrating means. As an additional means for sealing the container, the container may have mounted about the opening through which material is passed a conduit or tube which can be clamped or otherwise sealed to retain a vacuum. Such conduit or tube may comprise glass, metal, plastic or other structural material. Other known means for closing containers to form hermetic seals are also suitable for the purposes of this invention. Other inherent advantages and analogous embodiments will readily occur to those skilled in the art. Accordingly, the extent of the invention is intended to be limited only by the scope of the appended claims.

I claim:

1. An apparatus for filling a thermoplastic container with material under vacuum and then sealing the container comprising:

1. a housing defining an inlet for receiving a thermoplastic container having an open end through which the container can be filled with material, a chamber for enclosing the container while the container is being filled, and an outlet for discharging the container after it is filled and sealed;
2. a plurality of port valves disposed within said chamber, said valve means, when closed, subdividing said chamber into at least three air locks including in sequential order an entry lock, an operation lock and an exit lock and, when opened, permitting the passage of the container therethrough;
3. an evacuating means in communication with each of the three air locks;
4. a receptacle holding the material under vacuum in communication through a conduit with said operation lock; and 5. means for hermetically sealing said container disposed in the operation lock of said chamber whereby in operation while maintaining the operation lock and the receptacle under vacuum, the container with the open end outward is inserted into the entry lock, a first and second port valves defining the entry lock are closed, the entry lock is evacuated, the second port valve separating the entry lock from the evacuated operation lock is opened allowing the container to gravitate to a position in the operation lock such that the open end of the container is in communication through the conduit with the receptacle, a desired amount of the material is conveyed under vacuum from the receptacle into the open end of the container, the open end of the container is hermetically sealed by activating the remote controlled means, a third port valve separating the operation lock and the exit lock previously evacuated is opened allowing the container to gravitate into the exit lock, said third port valve is closed and a fourth port valve separating the exit lock from the outside is opened allowing the container to pass out of the apparatus wherein the means for sealing the container comprises a reciprocal, rotatable hollow shaft slidably disposed lengthwise in the operation lock and having a socket for receiving and holding a thermoplastic plug located at the end of said shaft extending into said operation lock, means for rotating and reciprocating said shaft and means for supplying at timed intervals thermoplastic plugs through the hollow of said shaft to said socket whereby in operation the means for supplying the plugs urges a plug into the socket and the shaft is moved to insert the plug into the open end of the container and rotated thereby fusing the plug to the container and forming a hermetic seal.

* * * * *